US008869785B2

(12) United States Patent
Bidigare et al.

(10) Patent No.: US 8,869,785 B2
(45) Date of Patent: Oct. 28, 2014

(54) STOP BRACKET APPARATUS FOR AN ARCHERY BOW

(75) Inventors: Eric C. Bidigare, Flint, MI (US); Kerry A. Verran, Davison, MI (US)

(73) Assignee: K Tech Designs, L.L.C., Flint, MI (US)

( * ) Notice: Subject to any disclaimer, the term of this patent is extended or adjusted under 35 U.S.C. 154(b) by 106 days.

(21) Appl. No.: 13/605,040

(22) Filed: Sep. 6, 2012

(65) Prior Publication Data

US 2014/0060514 A1 Mar. 6, 2014

(51) Int. Cl.
*F41B 5/20* (2006.01)
*F41B 5/14* (2006.01)

(52) U.S. Cl.
CPC ..... *F41B 5/1426* (2013.01)
USPC ..... 124/89; 124/86

(58) Field of Classification Search
USPC ..... 124/25.6, 86, 88, 89
See application file for complete search history.

(56) References Cited

U.S. PATENT DOCUMENTS

| | | | | |
|---|---|---|---|---|
| 4,054,121 | A * | 10/1977 | Hoyt, Jr. | 124/89 |
| 5,090,396 | A | 2/1992 | Bickel et al. | |
| 5,630,407 | A * | 5/1997 | Gasser | 124/89 |
| D442,251 | S | 5/2001 | Fitzgerald, Jr. | |
| D446,278 | S | 8/2001 | Fitzgerald, Jr. | |
| D448,827 | S | 10/2001 | Chipman | |
| 6,382,201 | B1 | 5/2002 | McPherson et al. | |
| 6,431,163 | B1 | 8/2002 | Chipman | |
| 6,550,467 | B2 | 4/2003 | Gallops, Jr. et al. | |
| 7,318,430 | B2 | 1/2008 | Leven | |
| 7,753,044 | B2 | 7/2010 | Goade | |
| 7,954,481 | B2 | 6/2011 | Barnard | |
| 8,033,277 | B2 | 10/2011 | Gordon et al. | |
| 8,225,778 | B2 | 7/2012 | Walk et al. | |
| 2009/0133683 | A1 * | 5/2009 | Wright | 124/89 |
| 2010/0192932 | A1 | 8/2010 | Brewster | |
| 2010/0224178 | A1 | 9/2010 | McPherson | |
| 2010/0326415 | A1 | 12/2010 | Walk et al. | |
| 2011/0120440 | A1 | 5/2011 | Stokes | |
| 2011/0247602 | A1 | 10/2011 | McPherson | |
| 2012/0125310 | A1 | 5/2012 | Khoshnood | |

* cited by examiner

*Primary Examiner* — John Ricci
(74) *Attorney, Agent, or Firm* — Young Basile Hanlon & MacFarlane P.C.

(57) ABSTRACT

A stop bracket apparatus for an archery bow having a cable for launching an arrow wherein said cable is moveable between a drawn position, wherein said arrow is ready to be released, and an undrawn position, wherein said arrow has already been released. The stop bracket apparatus includes a support structure that is releasably connectable to the archery bow. An energy absorbing element is connected to the support structure for absorbing residual energy in the support structure, the archery bow, and the cable when in the undrawn position. A bumper element is releasably connected to the support structure, and the bumper element is engageable with the cable when the cable is in the undrawn position for stopping the cable from advancing toward the archery bow. A weighting element may be connected to the support structure for properly weighting and absorbing energy from the archery bow.

19 Claims, 6 Drawing Sheets

STOP BRACKET APPARATUS FOR AN ARCHERY BOW

FIELD OF THE INVENTION

The present invention relates to the use of a stop bracket apparatus for a cable of an archery bow and, in particular, a stop bracket apparatus that absorbs the shock and vibration associated with the release of a cable from a compound archery bow.

BACKGROUND OF THE INVENTION

The archery bow is a simple mechanical device used to store energy derived from the archer during the drawing of the archery bow. When the archer releases the bow string or cable, the archery bow's energy is rapidly released. The greater portion of this energy is spent on launching the arrow, and much of the remaining energy is directed to the archery bow wherein the excess energy results in noise or is simply lost in the transfer process. Some of the energy directed back into the bow returns to its original undrawn state; however, much of this energy goes into excessive movement of various bow components, resulting in bow hand shock and system vibrations.

When shooting a compound archery bow, a cable is drawn and engages an arrow. When the cable is released, the cable snaps back toward the frame of the archery bow, thereby sending the arrow toward its target. Due to the amount of force applied to the cable, the cable snaps back toward the frame of the archery bow, thereby creating a certain amount of vibration and force realized by the archer through the archery bow. Certain previous designs have been established to stop the cable from snapping back toward the frame of the archery bow; however, the vibration and force are still transferred through such stop brackets to the frame of the archery bow, thereby applying a certain amount of pressure and vibration to the archer. Such vibration and force may affect the movement of the archery bow thereby affecting the projection of the arrow.

It would be desirable to provide a device that would stop a cable of an archery bow from snapping back toward the frame of the archery bow when released while also absorbing the shock and vibration associated with the release and stopping of the cable of the archery bow.

SUMMARY OF THE INVENTION

The present invention relates to a stop bracket apparatus for an archery bow having a cable for launching an arrow wherein the cable is moveable between a drawn position, wherein the arrow is ready to be released, and an undrawn position, wherein the arrow has already been released. The stop bracket apparatus of the present invention provides a support structure releasably connectable to the archery bow. An energy-absorbing element is connected to the support structure for absorbing residual energy in the support structure, the archery bow, and the cable in the undrawn position. A bumper element is releasably connected to the support structure and is engageable with the cable when the cable is in the undrawn position.

A releasable fastener is connected to the support structure and is releasably engageable with the archery bow. A threaded stud may be connected to the support structure and may be threadably received by the archery bow.

The support structure has an aperture extending therethrough for receiving the energy-absorbing element in a friction fit for releasably connecting the energy-absorbing element to the support structure. The energy-absorbing element may include a conventional stabilizer or a conventional dampener.

The bumper element may include a bracket connected to the support structure. A rod may be adjustably connected to the bracket, and a bumper may be connected to one end of the rod and engageable with the cable in the undrawn position. The bracket may have a releasable fastener for adjustably securing the rod fore and aft of the support structure.

A weighting element may be connected to the support structure for absorbing energy and properly weighting the archery bow. The weighting element may include at least one bracket releasably and adjustably connected to the support structure. A rod is adjustably connected to the at least one bracket, and a weight is connected to at least one end of the rod. The rod may have a weight connected to each end of the rod, and the at least one bracket may be adjustably connected to the rod between the weights, wherein the rod can be adjusted fore and aft of the bracket for adjusting the weighting of the archery bow.

The rod may have opposite ends, wherein one of the opposite ends is connected to the bracket, and the other of said opposite ends of the rod has a weight connected thereto. The at least one bracket is connected to the support structure about a longitudinal axis and may be rotationally adjustable about the longitudinal axis. The at least one bracket has a first portion connected to the support structure, and a second portion pivotally and adjustably connected to the first portion, wherein the second portion is connected to the rod for providing angular adjustment of the weight relative to the longitudinal axis.

BRIEF DESCRIPTION OF THE DRAWINGS

The various features, advantages and other uses of the present apparatus will become more apparent by referring to the following detailed description and drawings in which.

DETAILED DESCRIPTION

Figure 1:
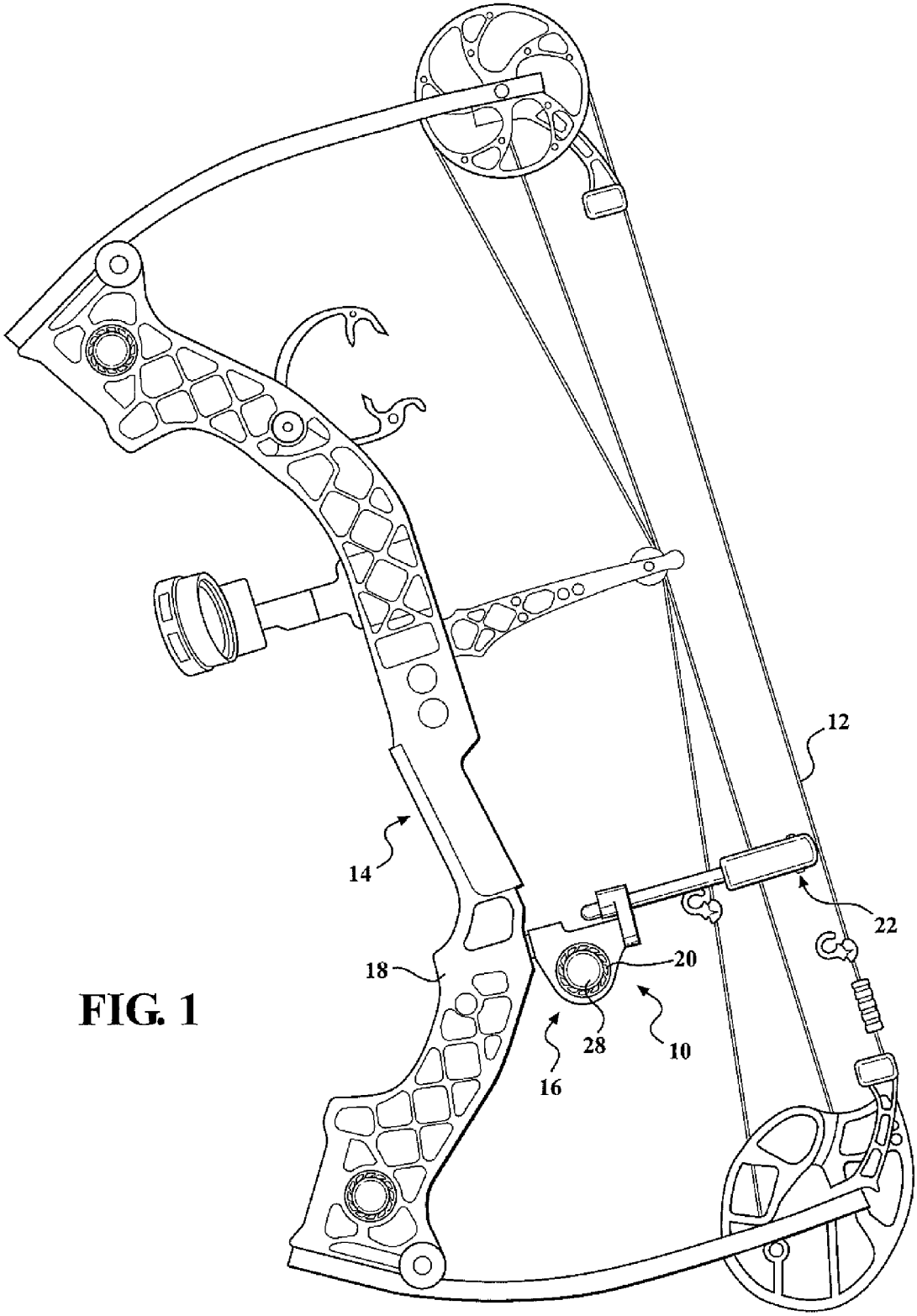
FIG. 1 is a front view of the stop bracket apparatus of the present invention mounted to a compound bow.

Referring to the drawings, the present invention will now be described in detail with reference to the disclosed embodiments.

As seen in FIGS. 1-6, the present invention provides for a stop bracket apparatus 10 for stopping and absorbing the shock and vibration of a cable 12 of an archery bow 14 upon the release of the cable 12. The cable 12 of the archery bow 14 may move between a drawn position, wherein the arrow is ready to be released, and an undrawn position, wherein the arrow has already been released. The archery bow 14 may include a conventional compound archery bow 14; however, the stop bracket apparatus 10 of the present invention may be utilized in conjunction with other archery bows that may benefit from the absorption of shock and vibration from the stopping of the cable 12 of an archery bow 14 as provided by the present invention. The stop bracket apparatus 10 of the present invention provides a support structure 16 that is releasably connectable to a body 18 of the archery bow 14. A threaded stud (not shown) may be connected to the support structure 16 and releasably threaded into a threaded aperture (not shown) provided in the body 18 of the archery bow 14. This releasable engagement allows the stop bracket apparatus 10 to be removed and/or connected to the archery bow 14, depending on the archer's desires. The support structure 16 has an energy-absorbing element 20 connected to the support structure 16. A bumper element 22 may be releasably connected to the support structure 16 for engaging the cable 12 when the cable 12 is in the undrawn position. In an alternative embodiment, the stop bracket apparatus 10 may also have a weighting element 24 connected to the support structure 16 for properly weighting the archery bow 14 and assisting in the absorption of energy from the cable 12 and the archery bow 14.

Figure 2:
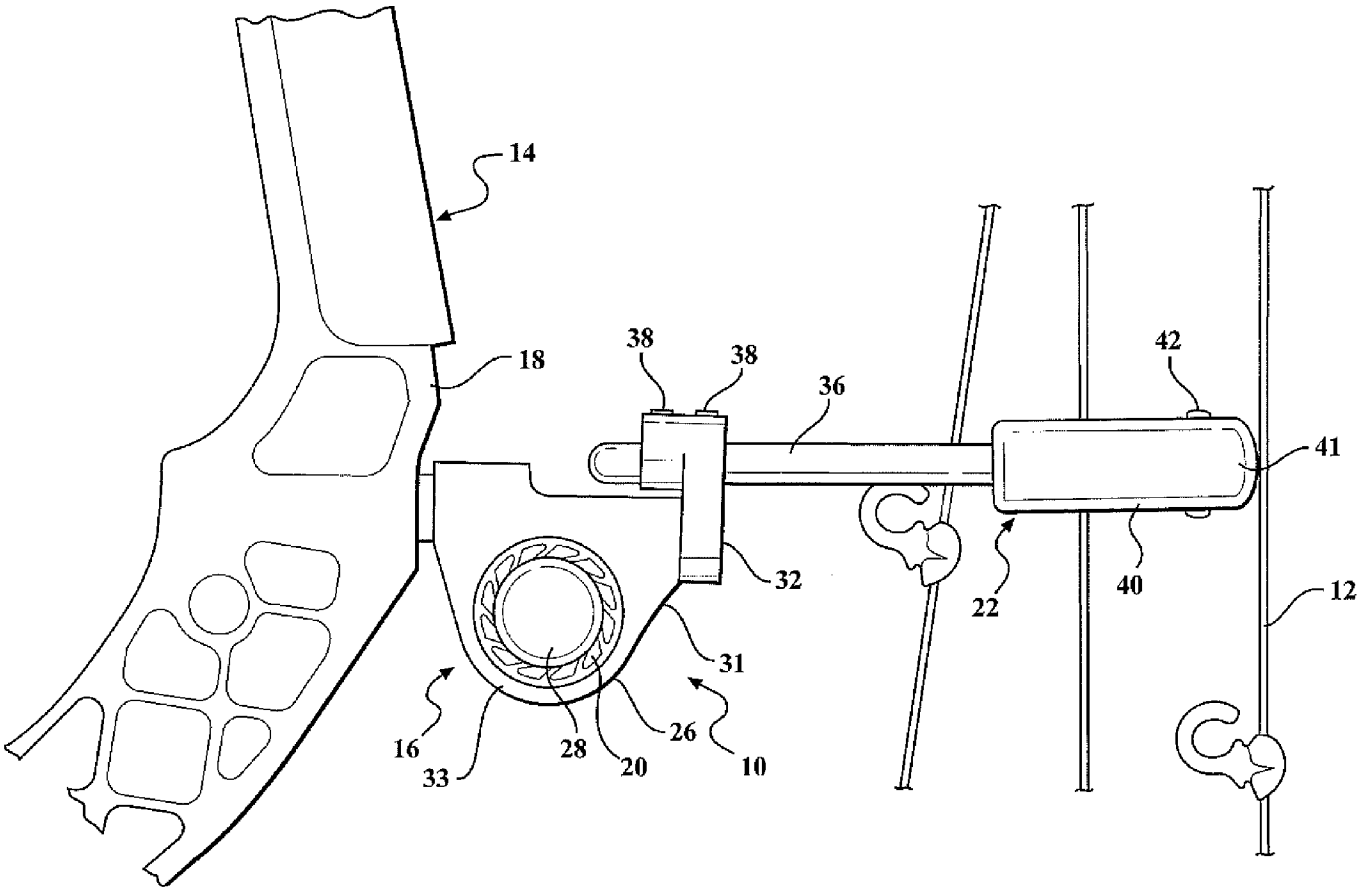
FIG. 2 is a perspective view showing the stop bracket apparatus of the present invention mounted to a compound bow.

In order to stop the cable 12 from snapping back toward the body of the archery bow 14 when the cable 12 is released from the drawn position, the stop bracket apparatus 10 of the present invention provides the support structure 16 having a substantially U-shaped configuration, as shown in FIGS. 1-2. The support structure 16 has an aperture 26 that extends through a central portion of the support structure 16. The aperture 26 in the support structure 16 is designed to receive a conventional stabilizer 28 or a conventional dampener 30 in a snap or friction fit. The stabilizer 28 and the dampener 30 are conventional, such as those manufactured and sold by Matthews, Inc., of Sparta, Wisconsin. Such conventional stabilizers 28 and dampeners 30 may be fabricated from a rubber spoke housing 31 having an alloyed metal core 33 centered in the rubber spoke housing 31. The stabilizers 28 and the dampeners 30 are designed to absorb the residual energy in the support structure 16 that is transferred from the archery bow 14 or the cable 12 to the support structure 16. The rubber-spoked housing 31 of the stabilizer 28 and the dampener 30 has a similar dimension to that of the aperture 26 in the support structure 16 such that a snap or friction fit is provided between the stabilizer 28 or the dampener 30 and the aperture 26 in the support structure 16. Any other conventional snap fit configuration may also be utilized between the stabilizer 28 or the dampener 30 and the aperture 26 in the support structure 16 such that the stabilizer 28 or the dampener 30 can be easily removed and exchanged should the archer desire to do so. The support structure 16 may be fabricated from a lightweight, high strength material, such as a metallic or a polymeric material.

To support the bumper element 22 of the stop bracket apparatus 10, a bumper bracket 32 is connected to the support structure 16. The bumper bracket 32 has a substantially L-shaped configuration with rounded ends on the bumper bracket 32. The bumper bracket 32 has an aperture extending through one end of a longer leg of the L-shaped configuration of the bumper bracket 32. The aperture receives a fastener 34 that extends through the aperture in the bumper bracket 32 and is received by a threaded aperture provided in the support structure 16. The fastener 34 secures the bumper bracket 32 to the support structure 16 and may allow for the rotational or pivotal adjustment of the bumper bracket 32 about the fastener 34. A short leg of the L-shaped configuration of the bumper bracket 32 extends beyond the support structure 16 and provides an aperture extending through the short leg of the L-shaped configuration of the bumper bracket 32. The aperture in the short leg of the bumper bracket 32 receives a rod 36 that extends toward the cable 12 of the archery bow 14. The bumper bracket 32 has a pair of set screws 38 that extend through threaded apertures in the bumper bracket 32 for securing the rod 36 to the bumper bracket 32. The set screws 38 are releasable such that the position of the rod 36 may be adjusted fore and aft of the support structure 16 and adjustably positioned with regard to the cable 12 of the archery bow 14. An end of the rod 36 extends toward the cable 12 and has a bumper 40 connected to the end of the rod 36. The bumper 40 may be fabricated from a hardened or reinforced rubber material so as to absorb some of the shock and vibration from the cable 12 of the archery bow 14 in the undrawn position. A free end 41 of the bumper 40 may be split into a substantially Y-shaped configuration so as to provide a greater surface area for catching and directing the cable 12 into the bumper 40 when the cable 12 is in the undrawn position. A reinforcement element 42 may be connected to the bumper 40 at the base of the Y-shaped end of the bumper 40 so as to prevent the bumper 40 from splitting and also for absorbing the forces supplied by the cable 12 in the undrawn position.

Figure 3:
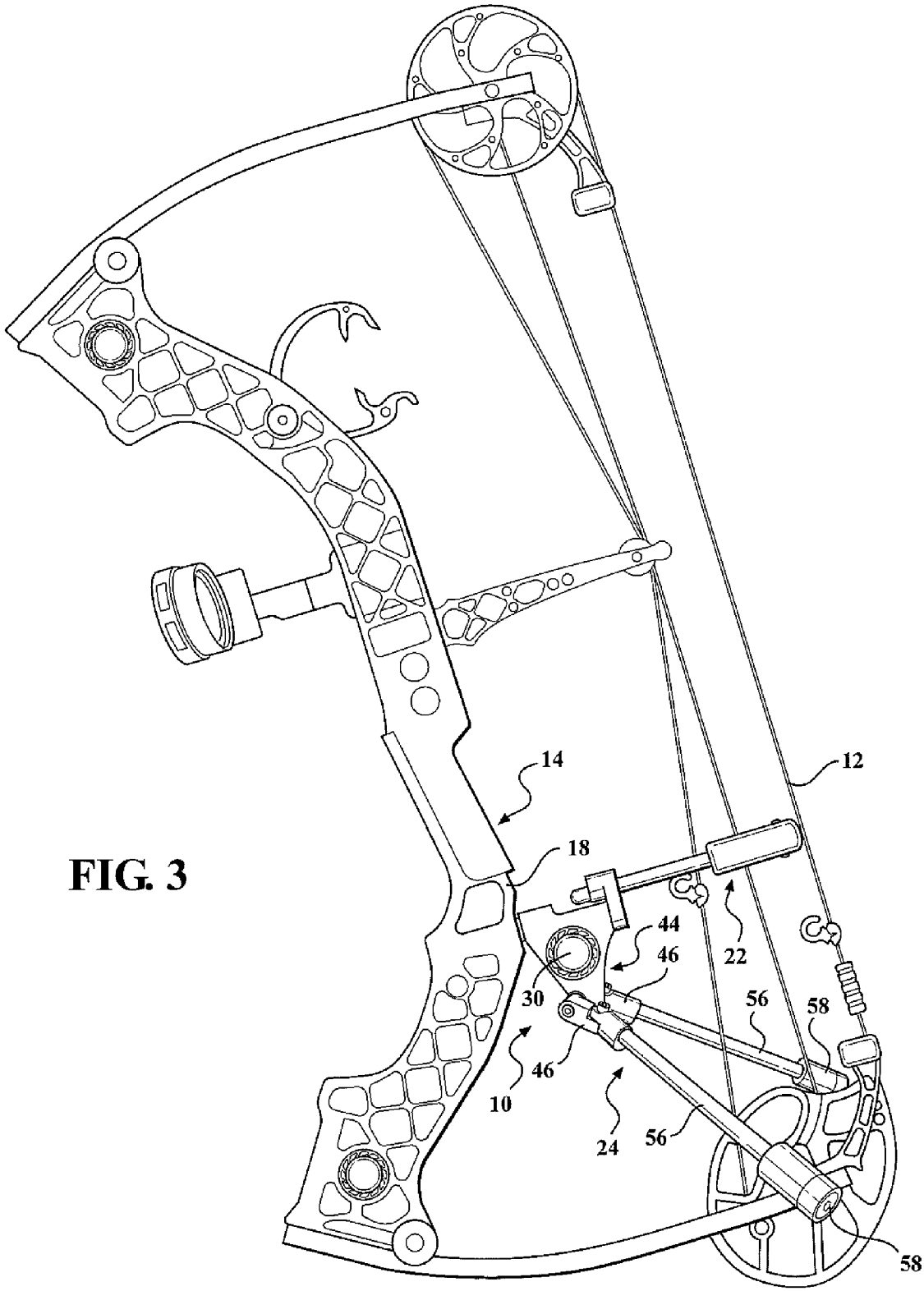
FIG. 3 is a front view of the stop bracket apparatus of the present invention having opposing weights and mounted to a compound bow.
Figure 4:
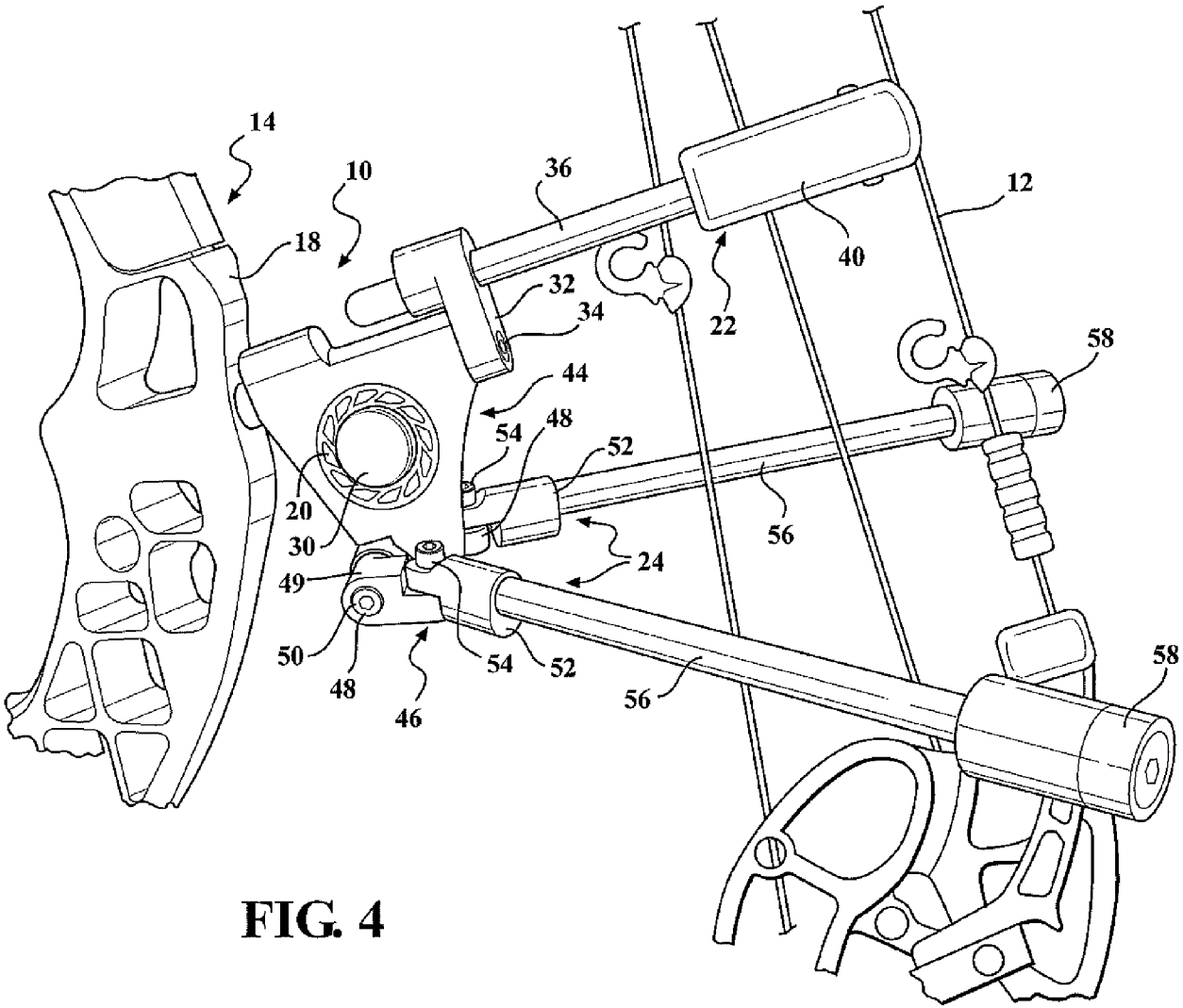
FIG. 4 is a perspective view of the stop bracket apparatus of the present invention having opposing weights and attached to a compound bow.

In another embodiment of the stop bracket apparatus 10 of the present invention, the weighting element 24 may be attached to the support structure 16 for properly weighting the archery bow 14 and absorbing residual forces in the support structure 16 received from the archery bow 14 and the cable 12, as seen in FIGS. 3-4. A support structure 44, similar to the support structure 16 described in the previous embodiment, is attached to the weighting element 24. The support structure 44 is connected to the archery bow 14 in the same manner as previously described, and the bumper element 22 is also connected to and provides the same structure as previously described.

The support structure 44 has a substantially triangular configuration, wherein the weighting elements 24 are mounted on the opposite side of the support structure 44 from the bumper element 22. The weighting element 24 has a weight bracket 46 mounted on each side of the support structure 44. Each weight bracket 46 has a first portion 48 that is connected to an adapter 49 on the support structure 44 through a fastener 50. The fastener 50 allows the weight bracket 46 to be rotationally adjusted about the fastener 50. A second portion 52 of the weight bracket 46 is releasably and adjustably connected to the first portion 48 of the weight bracket 46 by a fastener 54. The second portion 52 of the weight bracket 46 may be adjustably pivoted with respect to the first portion 48 of the weight bracket 46 about the fastener 54. The second portion 52 of the weight bracket 46 has a blind bore opening into a free end of the second portion 52 of the weight bracket 46. The blind bore of the second portion 52 of the weight bracket 46 receives a rod 56 that is connected to the second portion 52 of the weight bracket 46. The rod 56 extends outward from the second portion 52 of the weight bracket 46 and has a cylindrical weight 58 attached to a free end of the rod 56. The configuration of the weight bracket 46, the rod 56, and the weight 58 are the same for both weighting elements 24 provided on each side of the support structure 44. The position of the rod 56 and weight 58 may be angularly adjusted about the fastener 54 and may be rotationally adjusted about the fastener 50, per the archer's desires.

Figure 5:
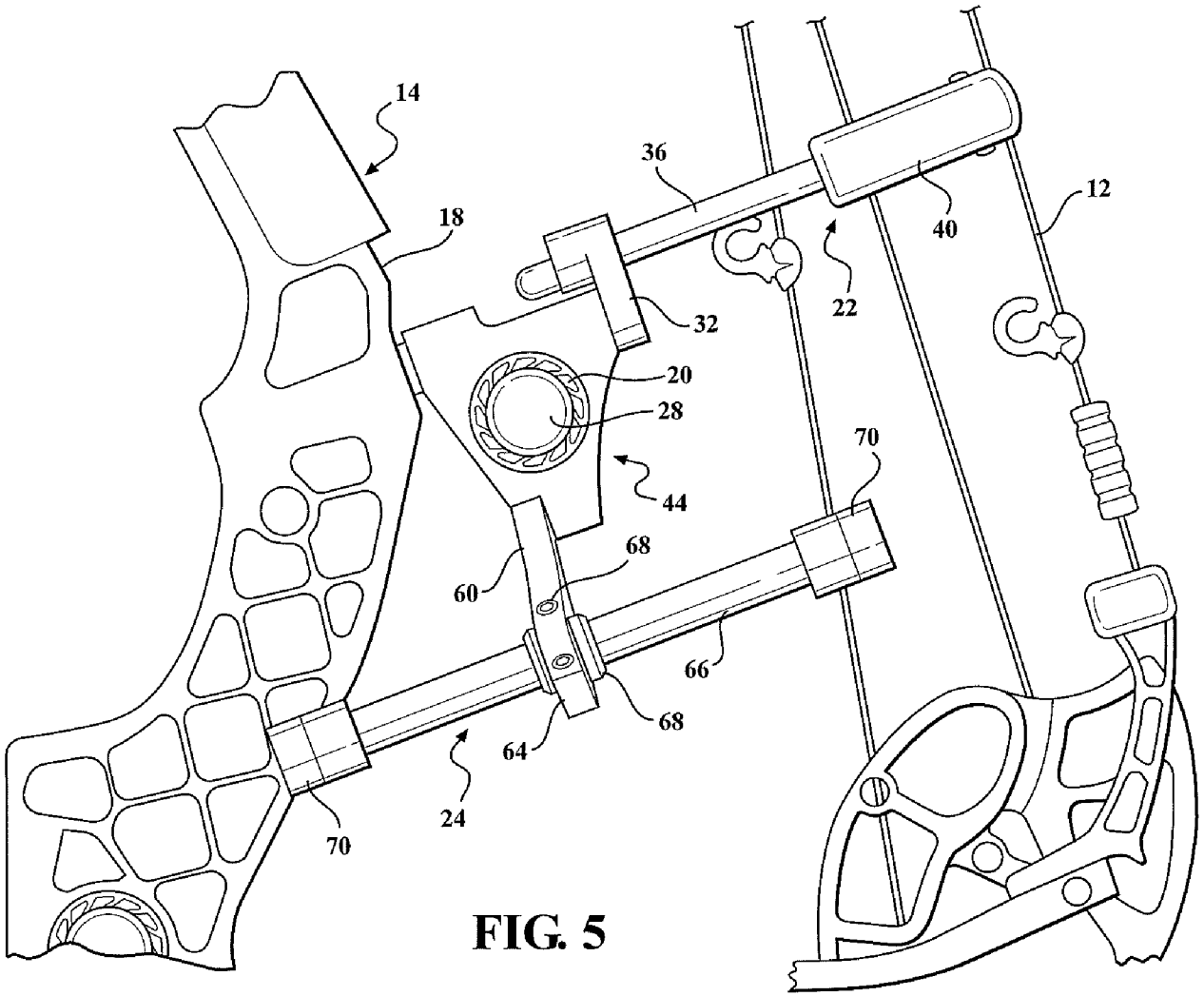
FIG. 5 is a front view of the stop bracket apparatus of the present invention having angularly adjustable weights and mounted to a compound bow.
Figure 6:
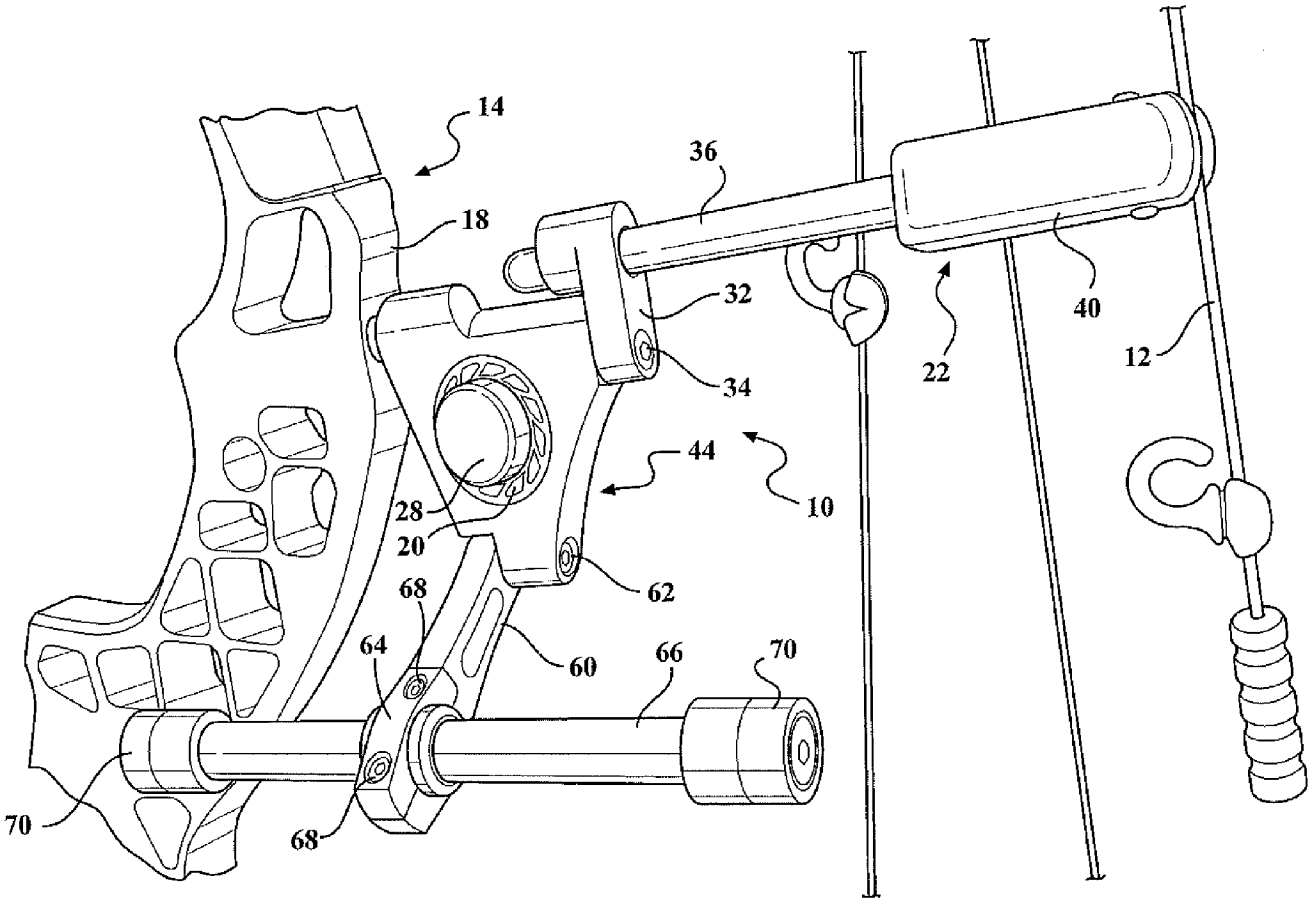
FIG. 6 is a perspective view of the stop bracket apparatus of the present invention having angularly adjustable weights and mounted to a compound bow.

In yet another embodiment, a different weighting element 24 is connected to the support structure 44, as seen in FIGS. 5-6. The support structure 44 has a similar configuration to that previously described. The support structure 44 is connected to the archery bow 14 in the same manner as previously described, and the bumper element 22 also has the same configuration as previously described. However, the weighting element 24 is different in that a single weight bracket 60 is connected to the support structure 44 at the opposite end of the support structure 44 from the bumper element 22. The weight bracket 60 has a substantially oval configuration wherein one end of the weight bracket 60 is connected to the support structure 44 by a fastener 62 that extends through an aperture provided in the weight bracket 60 and through an aperture provided in the support structure 44. The fastener 62 provides for rotational adjustment of the weight bracket 60 relative to the support structure 44 about the fastener 62. The opposite end of the weight bracket 60 provides a clamp 64 for receiving and securing a rod 66. The clamp 64 provides a pair of semi-circular portions that are connected to one another by a pair of conventional fasteners 68. The fasteners 68 allow the rod 66 to be adjustably positioned with respect to the weight bracket 60 along a longitudinal axis of the rod 66. A weight 70 is attached to each end of the rod 66. The position of the weight 70 may be adjusted along the longitudinal axis of the rod 66 by adjusting the fastener 68 and may be rotationally adjusted by rotating the weight bracket 60 through the fastener 62.

In use, the support structure 16 of the stop bracket apparatus 10 of the present invention may be connected to the archery bow 14. The rod 36 may be adjusted on the bumper element 22 such that the bumper 40 is in a proper location for stopping the cable 12 when in the undrawn position. The weighting of the archery bow may be adjusted by positioning of the weights 58, 70 through the adjustment of the weight brackets 46, 60. By properly adjusting the position of the bumper 40 and the weights 58, 70, the stop bracket apparatus 10 of the present invention should properly absorb the shock and vibration from the cable 12 of the archery bow 14 when in the undrawn position.

The invention claimed is:

1. A stop bracket apparatus for an archery bow having a cable for launching an arrow wherein said cable is movable between a drawn position, wherein said arrow is ready to be released, and an undrawn position, wherein said arrow has already been released, the stop bracket apparatus comprising:

a support structure releasably connectable to said archery bow;

an energy absorbing element connected to said support structure for absorbing residual energy in said support structure, said archery bow and said cable in the undrawn position; and a bumper element releasably connected to said support structure and spaced a longitudinal distance from said energy absorbing element, and said bumper element engageable with said cable when said cable is in said undrawn position for stopping said cable from advancing toward said archery bow.

2. The stop bracket apparatus as stated in claim 1, further comprising:

a releasable fastener connected to said support structure and releasably engageable with said archery bow.

3. The stop bracket apparatus as stated in claim 2, wherein said releasable fastener further comprises:

a threaded stud connected to said support structure and threadably receivable by said archery bow.

4. The stop bracket apparatus as stated in claim 1, wherein said energy-absorbing element further comprises:

a conventional stabilizer.

5. The stop bracket apparatus as stated in claim 1, wherein said energy-absorbing element further comprises:

a conventional dampener.

6. The stop bracket apparatus as stated in claim 1, wherein said bumper element further comprises:

a bracket connected to said support structure;

a rod adjustably connected to said bracket; and a bumper connected to one end of said rod and engageable with said cable in said undrawn position for stopping said cable from advancing toward archery bow and for absorbing shock and vibration from said cable in said undrawn position.

7. The stop bracket apparatus as stated in claim 6, further comprising:

said bracket having a releasable fastener for adjustably securing said rod fore and aft of said support structure.

8. The stop bracket apparatus as stated in claim 1, further comprising:

a weighting element adjustably connected to said support structure for properly weighting and absorbing energy from said archery bow.

9. The stop bracket apparatus as stated in claim 8, wherein said weighting element further comprises:

at least one bracket releasably and adjustably connected to said support structure;

a rod adjustably connected to each of said at least one bracket; and a weight connected to at least one end of said rod.

10. The stop bracket apparatus as stated in claim 9, further comprising:

said rod having a weight connected to each end of said rod, and said at least one bracket adjustably connected to said rod between said weights, wherein said rod may be adjusted fore and aft of said bracket for adjusting the weighting of said archery bow.

11. The stop bracket apparatus as stated in claim 9, further comprising:

said rod having opposite ends, wherein one of said opposite ends is connected to said bracket, and said other of said opposite ends of said rod having a weight connected thereto.

12. The stop bracket apparatus as stated in claim 9, further comprising:

said at least one bracket connected to said support structure about a longitudinal axis; and said at least one bracket rotationally adjustable about said longitudinal axis.

13. The stop bracket apparatus as stated in claim 12, wherein each of said at least one bracket further comprises:

a first portion adjustably connected to said support structure for providing rotational adjustment of said rod and said weight; and a second portion pivotally and adjustably connected to said first portion wherein said second portion is connected to said rod for providing angular adjustment of said weight relative to said longitudinal axis.

14. A stop bracket apparatus for an archery bow having a cable for launching an arrow wherein said cable is movable between a drawn position, wherein said arrow is ready to be released, and an undrawn position, wherein said arrow has already been released, comprising:

a support structure releasably connectable to said archery bow;

an energy-absorbing element connected to said support structure for absorbing residual energy in said support structure, said archery bow, and said cable after said archery bow and said cable have released said arrow;

a bumper bracket connected to said support structure;

a bumper rod adjustably connected to said bumper bracket for fore and aft adjustment of said rod relative to said support structure; and a bumper connected to a free end of said rod and engageable with said cable in said undrawn position for stopping said cable and absorbing shock and vibration from said cable when in said undrawn position.

15. The stop bracket apparatus as stated in claim 14, further comprising:

at least one weight bracket releasably and adjustably connected to said support structure;

a weight rod connected to each of said at least one weight bracket; and a weight connected to said weight rod for providing a desired weighting of said archery bow.

16. The stop bracket apparatus as stated in claim 15, further comprising:

a pair of weights mounted on the ends of said weight rod, and said weight rod engaged by said weight bracket between said weights for fore and aft adjustment of said weight rod relative to said support structure.

17. The stop bracket apparatus as stated in claim 15, further comprising:

said weight bracket pivotally adjustable with respect to said support structure about a longitudinal axis; and said weight bracket connected to one end of said weight rod, wherein said weight is connected to a free end of said weight rod for pivotal adjustment about said longitudinal axis.

18. The stop bracket apparatus as stated in claim 17, wherein said weight bracket further comprises:

a first portion adjustably connected to said support structure for providing rotational adjustment of said rod and said weight; and a second portion pivotally and adjustably connected to said first portion wherein said second portion is connected to said rod for providing angular adjustment of said weight relative to said longitudinal axis.

19. A stop bracket apparatus for an archery bow having a cable for launching an arrow wherein said cable is movable between a drawn position, wherein said arrow is ready to be released, and an undrawn position, wherein said arrow has already been released, the stop bracket apparatus comprising:

a support structure releaseably connectable to said archery bow;

an energy absorbing element connected to said support structure from absorbing residual energy in said support structure, said archery bow and said cable in the undrawn position;

a bumper element releasably connected to said support structure, and said bumper element engageable with said cable when said cable is in said undrawn position for stopping said cable from advancing toward said archery bow; and said support structure having an aperture extending there through for receiving said energy-absorbing element in a friction fit for releasably connecting said energy-absorbing element to said support structure.

* * * * *